US007489293B2

(12) United States Patent
Yamazaki et al.

(10) Patent No.: US 7,489,293 B2
(45) Date of Patent: Feb. 10, 2009

(54) PIXEL CIRCUIT DRIVING METHOD, PIXEL CIRCUIT, ELECTRO-OPTICAL DEVICE, AND ELECTRONIC APPARATUS

(75) Inventors: Katsunori Yamazaki, Matsumoto (JP); Shoichi Iino, Nirasaki (JP)

(73) Assignee: Seiko Epson Corporation, Tokyo (JP)

( * ) Notice: Subject to any disclaimer, the term of this patent is extended or adjusted under 35 U.S.C. 154(b) by 619 days.

(21) Appl. No.: 10/986,848

(22) Filed: Nov. 15, 2004

(65) Prior Publication Data

US 2005/0122289 A1 Jun. 9, 2005

(30) Foreign Application Priority Data

Nov. 21, 2003 (JP) ..... 2003-392185

(51) Int. Cl.
*G09G 3/32* (2006.01)

(52) U.S. Cl. ..... 345/82; 345/55; 345/76; 345/77; 345/78; 345/79; 345/84; 345/204; 315/169.3

(58) Field of Classification Search ..... 345/55, 345/76, 77, 78, 79, 82, 84, 204; 315/169.3
See application file for complete search history.

(56) References Cited

U.S. PATENT DOCUMENTS 6,501,466 B1 * 12/2002 Yamagishi et al. ..... 345/204
6,859,193 B1 * 2/2005 Yumoto ..... 345/82

FOREIGN PATENT DOCUMENTS

| | | |
|---|---|---|
| JP | A 10-197896 | 7/1998 |
| JP | A-2001-147659 | 5/2001 |
| JP | A-2001-188615 | 7/2001 |
| JP | A 2003-66903 | 3/2003 |
| JP | A-2003-186437 | 7/2003 |
| JP | A-2004-191932 | 7/2004 |
| JP | A-2005-505802 | 2/2005 |
| WO | WO 03/034381 A2 | 4/2003 |

* cited by examiner

*Primary Examiner*—My-Chau T Tran
(74) *Attorney, Agent, or Firm*—Oliff & Berridge, PLC

(57) ABSTRACT

To effectively reduce or prevent the deterioration of display quality caused by the errors included in the current supplied to an electro-optical element a pixel circuit includes a capacitor C1, transistors T1 and T2 that constitute a current mirror, and an organic EL element OLED. When a first driving mode is set, the transistor T1 functions as a programming element that writes data in the capacitor C1 in accordance with data current Idata and the second transistor T2 functions as a driving element that generates driving current Ioled in accordance with data stored in the capacitor C1. When the second driving mode that is alternately switched to the first driving mode in a predetermined period is set, the transistor T2 functions as the programming element and the transistor T1 functions as the driving element.

13 Claims, 8 Drawing Sheets

PIXEL CIRCUIT DRIVING METHOD, PIXEL CIRCUIT, ELECTRO-OPTICAL DEVICE, AND ELECTRONIC APPARATUS

BACKGROUND OF THE INVENTION

1. Field of Invention

Exemplary aspects of the present invention relate to a pixel circuit driving method, a pixel circuit, an electro-optical device, and an electronic apparatus, and more particularly, to switching of a driving mode of a pixel circuit.

2. Description of Related Art

The related art discloses preventing non-uniform output current caused by the non-uniformity in the inherent characteristics of a current controlling element which controls the output current by using a voltage as an input. For example, a thin film transistor circuit in which a current mirror does not include a pair of transistors but instead includes a plurality of transistor groups is disclosed. See Japanese Unexamined Patent Application Publication No. 10-197896. Further, a display panel driving circuit which periodically converts a plurality of current controlling elements into a plurality of current controlled elements to average the effects of non-uniformity in current is disclosed. See Japanese Unexamined Patent Application Publication No. 2003-66903.

SUMMARY OF THE INVENTION

However, although the method of Japanese Unexamined Patent Application Publication No. 10-197896 is used, non-uniformity in current is still prevalent in part due to varying factors in manufacturing processes. In particular, in a large screen display device, the presence of significant non-uniformity in current commonly occurs. Hence, it is still difficult to prevent spots from being generated. In the method of Japanese Unexamined Patent Application Publication No. 2003-66903, since average non-uniformity in current still exists in each shared block, block-shaped spots are consequently generated on the display.

Exemplary aspects of the present invention reduce or prevent the deterioration of display quality caused by the errors included in the current supplied to an electro-optical element.

In order to achieve the above, there is provided a method of driving a pixel circuit having a driving element, a capacitor, and an electro-optical element. The method includes: a first step of, when a first driving mode is set, setting the brightness of the electro-optical element by generating a first driving current by the driving element in accordance with data stored in the capacitor, and by supplying the first driving current to the electro-optical element; a second step of, when a second driving mode having a different connection state from the first driving mode is set, setting the brightness of the electro-optical element by the driving element by generating a second driving current in accordance with data stored in the capacitor, and by supplying the second driving current to the electro-optical element, an error polarity of the second driving current being opposite to an error polarity of the first driving current; and a third step of alternately switching between the first driving mode and the second driving mode in a predetermined period.

In a first exemplary aspect of the invention, the first step may include a step of writing data in the capacitor in accordance with data current supplied from the outside of the pixel circuit by using a first transistor that constitutes a current mirror included in the pixel circuit and a step of generating the first driving current in accordance with data stored in the capacitor by using a second transistor that constitutes the current mirror as the driving element. The second step may include a step of writing data in the capacitor in accordance with the data current by using the second transistor and a step of generating the second driving current in the capacitor in accordance with data stored by using the first transistor as the driving element.

In the first exemplary aspect of the invention, the first step may include a step of writing data in the capacitor by charging the capacitor by using a current flowing through the channel of the driving element, when a data voltage supplied from the outside is applied to a gate of the driving element. The second step may include writing data in the capacitor by discharging charge accumulated in the capacitor by using a second current flowing through the channel of the driving element in a reverse direction to the direction of the first current when the data voltage is applied to the gate of the driving element. In this case, the first step may include a step of setting the capacitor in an initial state by discharging charge accumulated in the capacitor by applying a first voltage to one electrode of the capacitor prior to the step of writing data in the capacitor. The second step may include a step of setting the capacitor in an initial state by charging the capacitor by applying a second voltage higher than the first voltage to one electrode of the capacitor prior to the step of writing data in the capacitor.

In the first exemplary aspect of the invention, switching between the first driving mode and the second driving mode may be performed in units of pixels, in units of pixel rows, in units of pixel columns, or in units of pixel blocks. Also, the period of switching between the driving modes may be no more than 1/30 second.

In a second exemplary aspect of the invention, there is provided a pixel circuit including a capacitor to store data, a driving element to generate a driving current in accordance with data stored in the capacitor and having its gate connected to the capacitor, and an electro-optical element, whose brightness is set in accordance with the driving current supplied from the driving element. The pixel circuit may include a connector to make the connection state of the pixel circuit when the first driving mode is set different from the connection state of the pixel circuit when the second driving mode is set. The connector sets the connection state of the pixel circuit such that the driving element generates a first driving current in accordance with data stored in the capacitor when the first driving mode is set, and sets the connection state of the pixel circuit such that the driving element generates a second driving current, whose error polarity is opposite to an error polarity of the first driving current, in accordance with data stored in the capacitor when a second driving mode, which is alternately switched to the first driving mode in a predetermined period, is set.

In a third exemplary aspect of the invention, there is provided a pixel circuit including a capacitor to store data, first and second transistors constituting a current mirror and having gates connected to a node to which one electrode of the capacitor is connected, the first and second transistors constituting a current mirror, and an electro-optical element, whose brightness is set by a driving current flowing therethrough. When a first driving mode is set, the first transistor functions as a programming element to write data in the capacitor in accordance with data current supplied from the outside of the pixel circuit, and the second transistor functions as a driving element to generate the driving current in accordance with data stored in the capacitor. When a second driving mode, which is alternately switched to the first driving mode in a predetermined period, is set, the second transistor functions as the programming element and the first transistor functions as the driving element.

In the third exemplary aspect of the invention, the pixel circuit may include third to sixth transistors. The third transistor has one terminal connected to the node and another terminal connected to one terminal of the first transistor. The third transistor is switched on when the first driving mode is set and is switched off when the second driving mode is set. The fourth transistor has one terminal connected to the node and another terminal connected to the one terminal of the second transistor. The fourth transistor is switched on when the second driving mode is set and is switched off when the first driving mode is set. The fifth transistor has one terminal connected to one terminal of the first transistor and another terminal connected to the electro-optical element. The fifth transistor is switched on when the second driving mode is set and is switched off when the first driving mode is set. The sixth transistor has one terminal connected to one terminal of the second transistor and another terminal connected to the electro-optical element. The sixth transistor is switched on when the first driving mode is set and is switched off when the second driving mode is set.

In the second or third exemplary aspect of the invention, switching between the first driving mode and the second driving mode may be performed in units of pixels, in units of pixel rows, in units of pixel columns, or in units of pixel blocks. Also, the period of switching between the driving modes may be no more than 1/30 second.

In a fourth exemplary aspect of the invention, there is provided an electro-optical device including a plurality of scanning lines, a plurality of data lines, a plurality of pixel circuits provided corresponding to intersections of the scanning lines and the data lines, a scanning-line driving circuit to select scanning lines corresponding to the pixel circuits in which data is to be written by outputting a scanning signal to the scanning lines, and a data-line driving circuit to output data to the data lines corresponding to the pixel circuits in which data is to be written in cooperation with the scanning-line driving circuit. The pixel circuit is the pixel circuit according to the second or third exemplary aspect of the invention.

In a fifth exemplary aspect of the invention, there is provided an electronic apparatus including an electro-optical device according to the fourth exemplary aspect of the invention.

In a sixth exemplary aspect of the invention, there is provided a method of driving a pixel circuit having a driving element, a capacitor, and an electro-optical element. The driving method includes: a first step of writing data in the capacitor in accordance with the multiplication of channel current that flows through the channel of the driving element by a predetermined time by applying a data voltage supplied from the outside to the gate of the driving element; a second step of generating driving current by the driving element in accordance with data stored in the capacitor; and a third step of setting the brightness of the electro-optical element by supplying driving current to the electro-optical element.

Here, in the sixth exemplary aspect of the invention, prior to writing data in the capacitor, a fourth step of setting charge of the capacitor in an initial state may be included.

According to an exemplary aspect of the present invention, since the first driving mode and the second driving mode are alternately set, the error included in the driving current generated when the first driving mode is set and the error of the reverse polarity included in the driving current generated when the second driving mode is set to offset each other. Thus, since the error of the effective driving current supplied to the electro-optical element is reduced, it is possible to effectively reduce or prevent display quality from deteriorating.

DETAILED DESCRIPTION OF EXEMPLARY EMBODIMENTS

Figure 1:
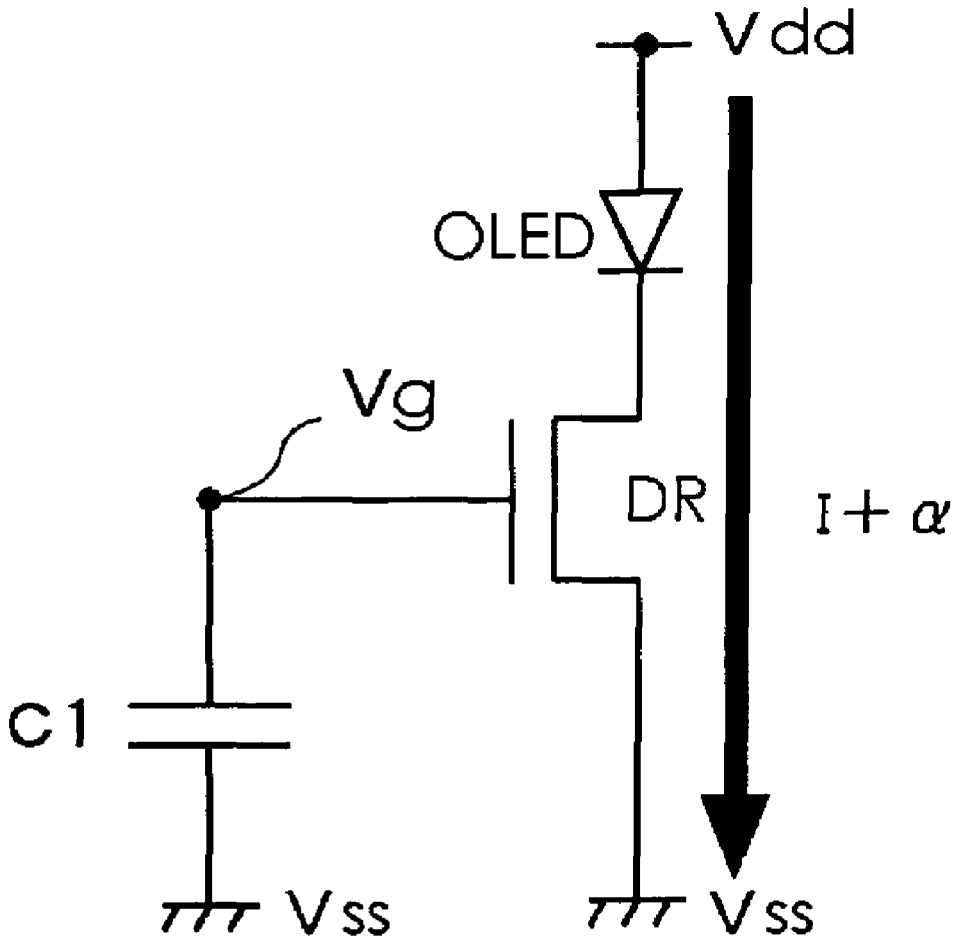
FIG. 1 is a schematic illustrating the basic principle of an exemplary aspect of the present invention.

Prior to describing exemplary embodiments, the basic principle of an exemplary aspect of the present invention will be described with reference to FIG. 1. Data is written in a capacitor C1 by a data current or data voltage supplied from the outside. When a gate voltage Vg in accordance with the data is applied to the gate of a driving element DR, the driving element DR generates driving current in accordance with the gate voltage Vg in its own channel. The driving current is supplied to an organic EL element OLED, such that the organic EL element OLED emits light and brightness is set. In a display panel where pixels each having the structure illustrated in FIG. 1 are arranged in a matrix, it is not possible to make the characteristics of all of the driving elements DR the same, such that non-uniformity in characteristics actually exists. Due to the effects of the non-uniformity, the real driving current is I+α, obtained by adding error α to desired current I. The value a varies in accordance with the characteristic of each driving element DR and can be either negative or positive. The non-uniformity in the driving current, which is caused by the error α, deteriorates the display quality.

In order to reduce or prevent the display quality from deteriorating, driving with the driving current of I+α and driving with the driving current of I−α are alternately performed. Specifically, when a driving method in which the polarity of the error α included in the driving current is alternately inverted is used, it is possible to effectively reduce the bad influence on display caused by the error α. In this case, an effective driving current Ieff can be represented by Equation 1. According to Equation 1, although α/I is about 10%, the error of the effective current Ieff is reduced to about 0.5%. Thus, it is possible to significantly reduce the current error with respect to the organic EL element OLED.

$$Ieff = \sqrt{\frac{(idata+\alpha)^2 + (idata+\alpha)^2}{2}} = Idata \cdot \sqrt{1 + \left(\frac{\alpha}{i}\right)^2} \quad \text{Equation 1}$$

-continued $$= Idata \cdot \left\{1 + \frac{1}{2}\left(\frac{\alpha}{i}\right)^2\right\}$$

Various methods of alternately inverting the polarity of the error α have been suggested. Among the methods, two representative methods will be described. According to a first exemplary embodiment, in a current-mirror-type pixel circuit, a method of alternately switching between a programming element and a driving element using a current-mirror-type pixel circuit will be described. According to a second exemplary embodiment, a method of alternately performing writing of data by discharging and writing of data by charging by alternately inverting the direction of the channel current of the driving element will be described.

First Exemplary Embodiment

Figure 2:
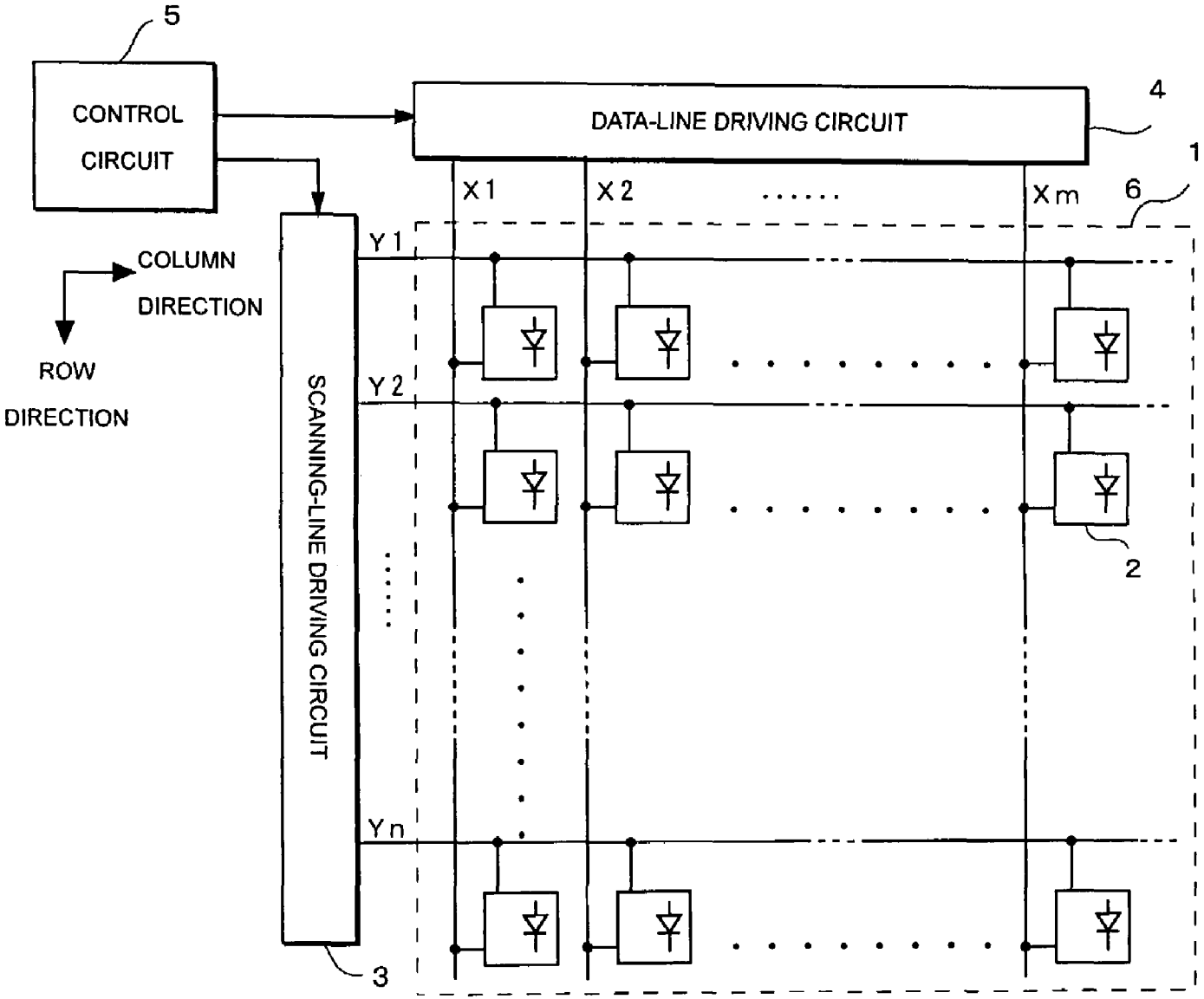
FIG. 2 is a schematic of an electro-optical device.

FIG. 2 is a schematic of an electro-optical device according to the present embodiment. A display unit 1 is an active-matrix-type display panel for driving an electro-optical element by a thin film transistor (TFT). In the display unit 1, pixel groups of m dots×n lines are arranged in a matrix (in a two dimensional plane). In the display unit 1, scanning line groups Y1 to Yn that extend in a horizontal direction and data line groups X1 to Xm that extend in a vertical direction are provided and pixels 2 are arranged corresponding to intersections of the scanning line groups Y1 to Yn and the data line groups X1 to Xm. When the display unit 1 is a monochrome panel, one pixel 2 corresponds to one pixel circuit that will be described later. When one pixel 2 includes three sub-pixels of RGB like in a color panel, one sub-pixel corresponds to one pixel circuit.

A control circuit 5 synchronously controls a scanning-line driving circuit 3 and a data-line driving circuit 4 based on a vertical synchronizing signal Vs, a horizontal synchronizing signal Hs, a dot clock signal DCLK, and grayscale data D input from an upper device (not shown). Under the synchronous control, the circuits 3 and 4 control display of the display unit 1 in cooperation with each other.

The scanning-line driving circuit 3 includes a shift register and an output circuit, and outputs a scanning signal SEL to the scanning lines Y1 to Yn to line-sequentially scan the scanning lines Y1 to Yn. The scanning signal SEL has two signal levels, such as a high potential level (hereinafter, "H level") and a low potential level (hereinafter, "L level"). Scanning lines Y corresponding to the pixel rows to which data is written are set at the H level, and the other scanning lines Y are set at the L level. The scanning-line driving circuit 3 performs a line-sequential scanning such that the respective scanning lines Y are sequentially selected every period (1F) of displaying an image of one frame in a predetermined selection order (in common, from the uppermost to the lowermost).

The data-line driving circuit 4 includes a shift register, a line latch circuit, and an output circuit. According to the present exemplary embodiment, since a current program method in which data is supplied to the data lines X based on current, is adopted, the data-line driving circuit 4 includes a variable current source (4*a* of FIG. 3) to variably generate data current Idata based on grayscale data that defines the display grayscale of the pixel 2. In one horizontal scanning period (1H) corresponding to a period in which one scanning line Y is selected, the data-line driving circuit 4 simultaneously outputs the data current Idata to the pixel row in which this time data is written, and point-sequentially latches data to a pixel row in which data will be written in the next 1H. In an arbitrary 1H, m data items corresponding to the number of data lines X are sequentially latched. In the next 1H, the latched m data items are switched to current data Idata by a variable current source and are simultaneously output to the corresponding data lines X1 to Xm.

Figure 3:
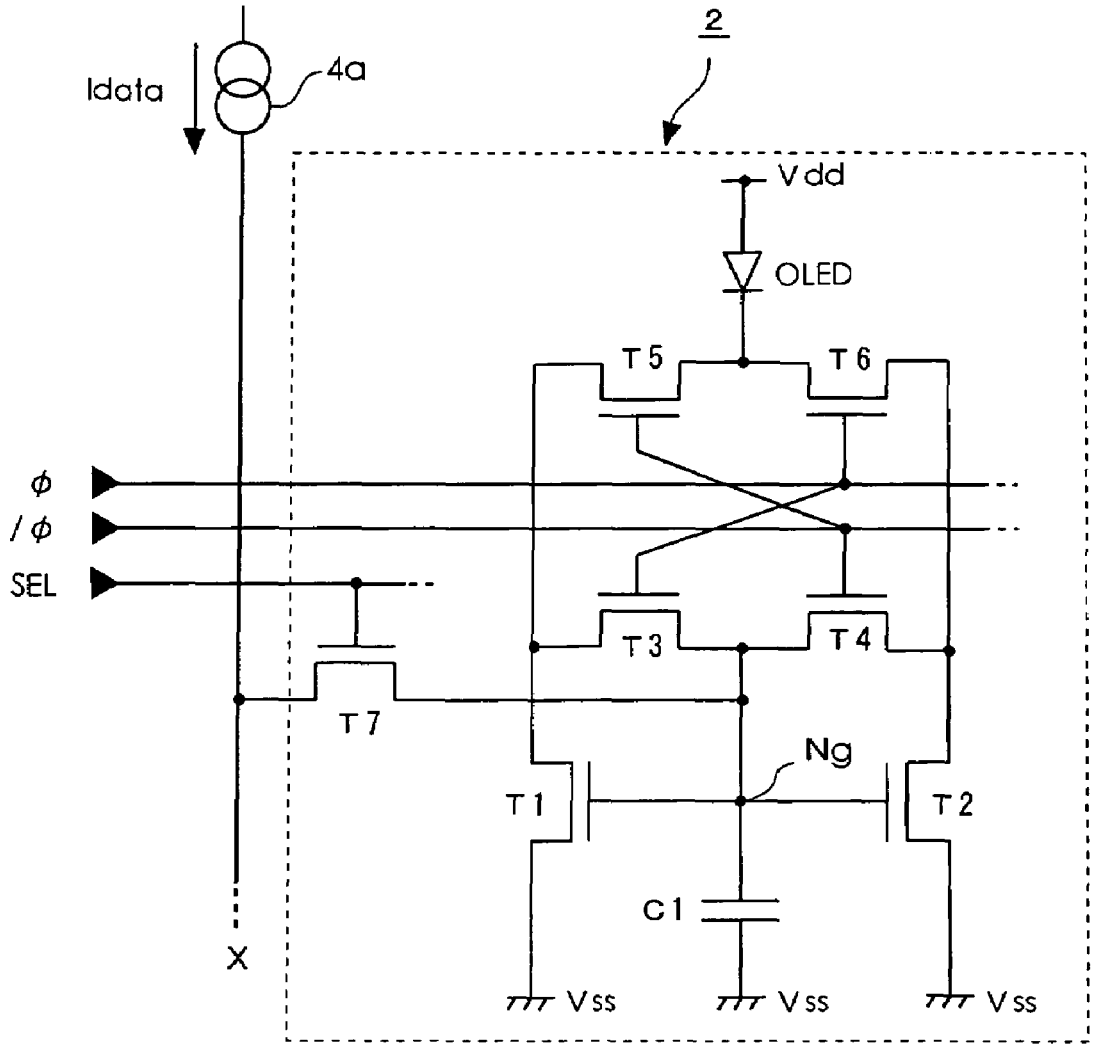
FIG. 3 is a pixel circuit schematic according to a first exemplary embodiment.

FIG. 3 is a current-mirror-type pixel circuit schematic according to the present exemplary embodiment. A pixel 2 includes an organic EL element OLED, seven transistors T1 to T7, and a capacitor C1 to store data. The organic EL element OLED displayed as a diode is a typical current driving element whose brightness is set by driving current Ioled that flows therethrough. The transistors T1 and T2 function as programming elements that write data in accordance with the data current Idata in the capacitor C1, or driving elements that generate the driving current Ioled in accordance with the data stored in the capacitor C1. The transistors T3 to T7 function as switching elements. According to this structure, the transistors T1 to T7 are n-channel types, which is one example. Transistors with channel types having different combinations may be used. According to the present specification, with respect to a transistor that is a three-terminal-type element having a source, a drain, and a gate, one of the source and the drain is referred to as one terminal and the other is referred to as the other terminal.

The gate of the transistor T7 is connected to the scanning line Y to which the scanning signal SEL is supplied and the one terminal is connected to the data line X to which the data current Idata is supplied. Also, the other terminal of the transistor T7 is connected to a node Ng. The gates of the pair of transistors T1 and T2 that constitute a current mirror, the one electrode of the capacitor C1, and the one terminals of each of the transistors T3 and T4 are commonly connected to the node Ng. The one terminal of the transistor T1 is commonly connected to the other terminal of the transistor T3 and to the one terminal of the transistor T5. The one terminal of the transistor T2 is commonly connected to the other terminal of the transistor T4 and to the one terminal of the transistor T6. The other terminals of the transistors T5 and T6 are commonly connected to each other. The cathode of the organic EL element OLED is connected to the connection ends of the transistors T5 and T6. A source voltage Vdd is supplied to the anode of the organic EL element OLED. A reference voltage Vss smaller than the source voltage Vdd is supplied to the other terminals of the transistors T1 and T2 and to the other electrode of the capacitor C1. The gates of the transistors T3 and T6 are connected to a control line to which a control signal ϕ output from the control circuit 5 is supplied and the gates of the transistors T4 and T5 are connected to a control line to which an inverted control signal /ϕ is supplied.

Figure 4:
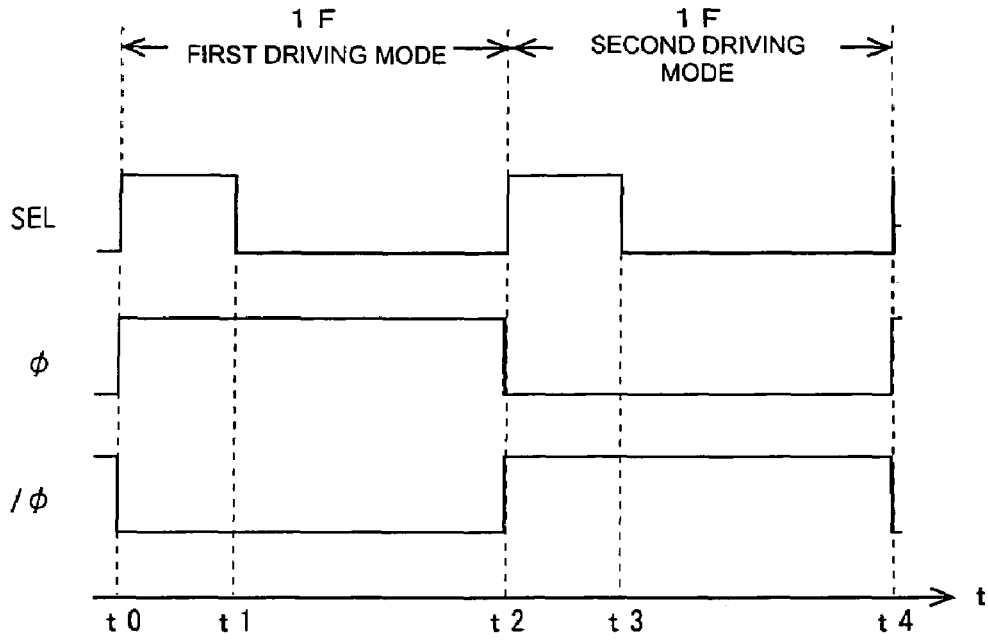
FIG. 4 is a timing chart of operations according to the first exemplary embodiment.

FIG. 4 is an operation-timing chart of the pixel circuit illustrated in FIG. 3. The driving modes of the pixel circuit include a first driving mode and a second driving mode. The driving modes are alternately set in a predetermined period (for example, every 1F). The connection state of the pixel circuit in the first driving mode is different from the connection state of the pixel circuit in the second driving mode. A series of processes in a period t0 to t2 (t2 to t4) corresponding to 1F is divided into a data writing process in an initial period t0 to t1 (t2 to t3) and a driving process in a subsequent period t1 to t2 (t3 to t4).

Figure 5:
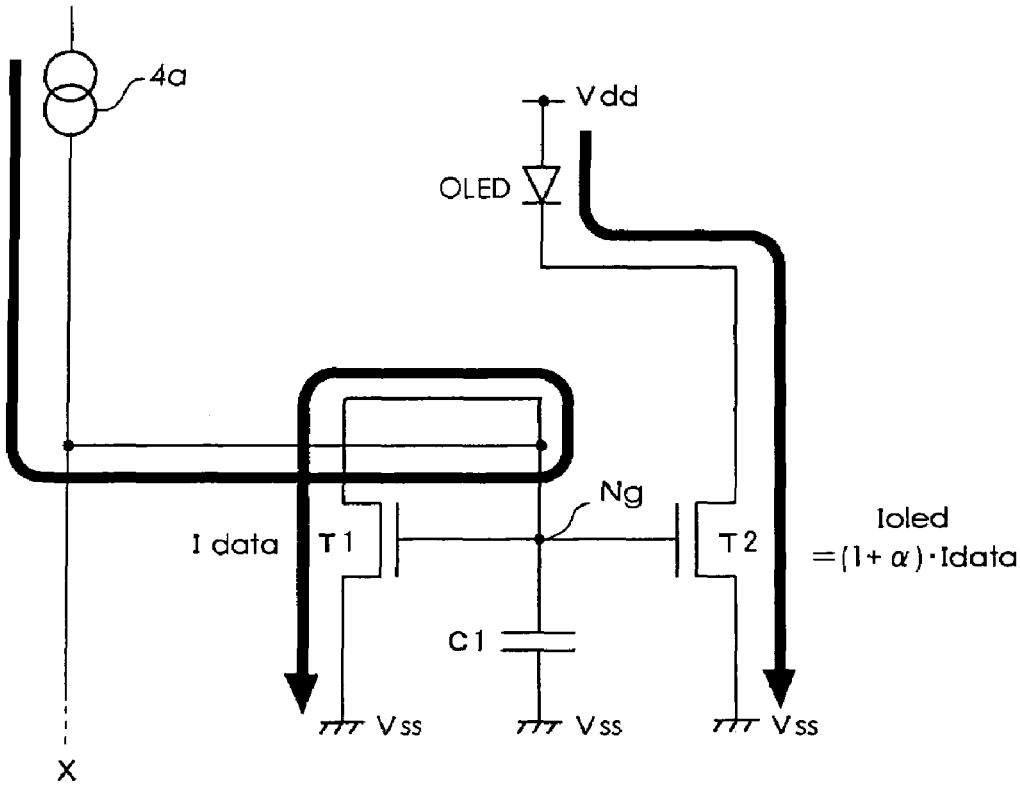
FIG. 5 is a schematic illustrating operations in a first driving mode.

In the initial 1F (t0 to t2), the control signal ϕ is at the H level (the inverted control signal /ϕ is at the L level) and is in the first driving mode. In the first driving mode, the transistor T1 functions as a programming element and the transistor T2 functions as a driving element. In the data writing period t0 to t1, data is written in the capacitor C1 using the transistor T1 that functions as the programming element. To be specific, since the scanning signal SEL is raised to the H level and the transistor T7 is switched on, the node Ng is electrically connected to the data lines X. Also, since the control signal ϕ is at the H level, the transistors T3 and T6 are switched on (the transistors T4 and T5 are switched off). Since the transistor T3 is switched on, the transistor T1 performs a diode connection in which the gate thereof is electrically connected to the drain thereof. Thus, as illustrated in FIG. 5, the path of the data current Idata is formed such that the data current Idata supplied by the variable current source 4*a* flows through the channel of the transistor T1. The transistor T1 generates the voltage in accordance with the data current Idata that flows through the channel thereof in the gate thereof, specifically, the node Ng. Charge in accordance with the gate voltage Vg are accumulated in the capacitor C1 connected to the gate of the transistor T1 and data corresponding to the accumulated charge is written in the capacitor C1 connected to the gate of the transistor T1.

Since the transistor T6 is switched on, the cathode of the organic EL element OLED is electrically connected to the one terminal of the transistor T2. Thus, the path of the driving current Ioled illustrated in FIG. 5 is formed in the order of the source voltage Vdd, the organic EL element OLED, the channel of the transistor T2, and the reference voltage Vss. The driving current Ioled that flows through the organic EL element OLED corresponds to the channel current of the transistor T2 that functions as a driving element. The current level of the driving current Ioled is controlled by the gate voltage Vg dependent on the data stored in the capacitor C1. Since the pair of transistors T1 and T2 constitute the current mirror, the driving current Ioled that defines the light-emitting brightness of the organic EL element (OLED) is proportional to the data current Idata (the channel current of the transistor T1) supplied by the data lines X.

In the subsequent driving period t1 to t2, since the scanning signal SEL is lowered to the L level and the transistor T7 is switched off, the node Ng is electrically separated from the data lines X. However, since the gate voltage Vg is continuously applied to the gate of the transistor T2 due to the data stored in the capacitor C1, the driving current Ioled continuously flows through the organic EL element OLED. Thus, the organic EL element OLED continuously emits light with the brightness in accordance with the driving current Ioled.

Figure 6:
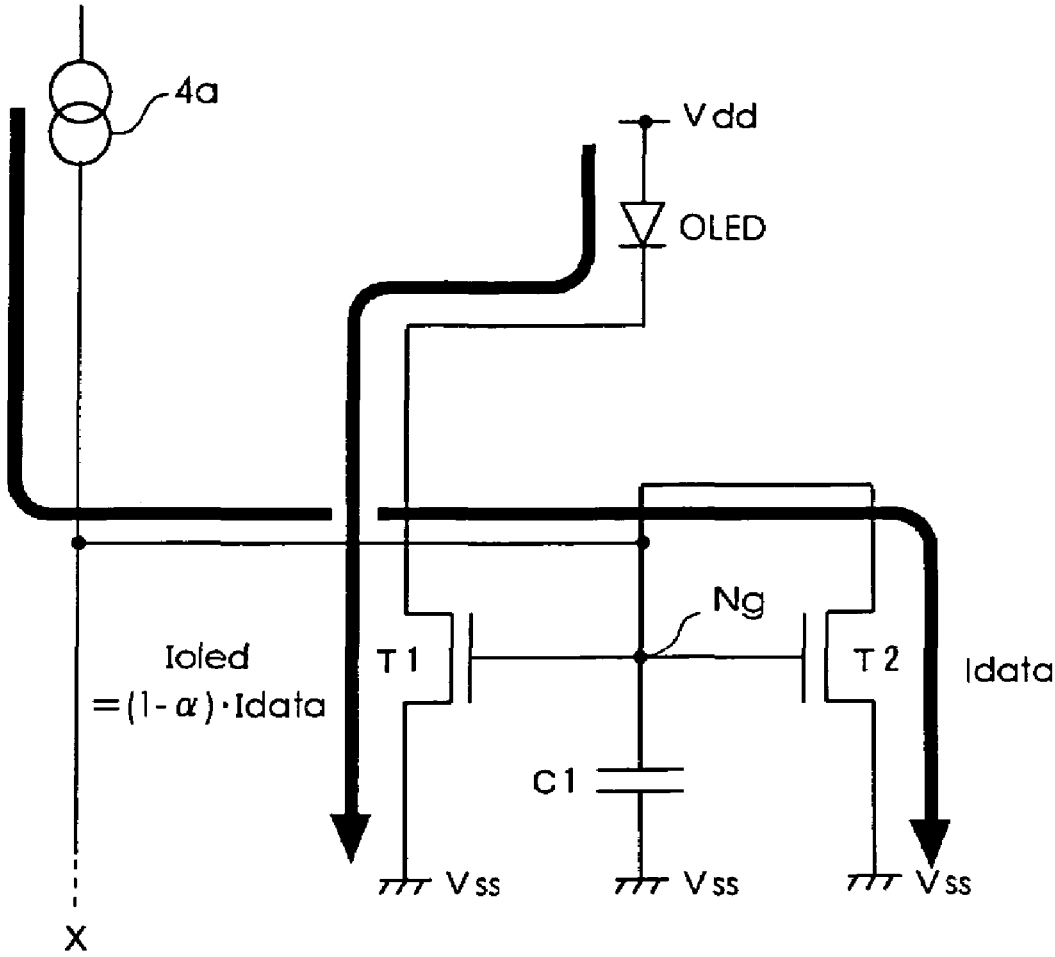
FIG. 6 is a schematic illustrating operations in a second driving mode.

In the next 1F (t2 to t4), the control signal ϕ is at the L level (the inverted control signal /ϕ is at the H level) and is in the second driving mode. In the second driving mode, a connection state different from the connection state in the first driving mode is established. The transistor T2 functions as a programming element and the transistor T1 functions as a driving element. In the data writing period t2 to t3, data is written in the capacitor C1 using the transistor T2 that functions as the programming element. To be specific, since the scanning signal SEL is raised to the H level and the transistor T7 is switched on, the node Ng is electrically connected to the data lines X. Also, since the inverted control signal /ϕ is at the H level, the transistors T4 and T5 are switched on (the transistors T3 and T6 are switched off). Since the transistor T4 is switched on, the transistor T2 performs a diode connection in which the gate thereof is electrically connected to the drain thereof. Thus, as illustrated in FIG. 6, the path of the data current Idata is formed such that the data current Idata supplied by the variable current source 4*a* flows through the channel of the transistor T2. The transistor T2 generates the voltage in accordance with the data current Idata that flows through the channel thereof in the gate thereof, specifically, the node Ng. Charge in accordance with the gate voltage Vg is accumulated in the capacitor C1 connected to the gate of the transistor T2 and data corresponding to the accumulated charge is written in the capacitor C1 connected to the gate of the transistor T2.

Since the transistor T5 is switched on, the cathode of the organic EL element (OLED) is electrically connected to the one terminal of the transistor T1. Thus, the path of the driving current Ioled illustrated in FIG. 6 is formed in the order of the source voltage Vdd, the organic EL element OLED, the channel of the transistor T1, and the reference voltage Vss. The driving current Ioled that flows through the organic EL element OLED corresponds to the channel current of the transistor T1 that functions as a driving element. The current level of the driving current Ioled is controlled by the gate voltage Vg dependent on the data stored in the capacitor C1. According to the above-described structure of the current mirror, the driving current Ioled that defines the light-emitting brightness of the organic EL element OLED is proportional to the data current Idata (the channel current of the transistor T1) supplied by the data lines X.

In the subsequent driving period t3 to t4, since the scanning signal SEL is lowered to the L level and the transistor T7 is switched off, the node Ng is electrically separated from the data lines X. However, even after the separation, since the gate voltage Vg is continuously applied to the gate of the transistor T1 due to the data stored in the capacitor C1, the driving current Ioled continuously flows through the organic EL element OLED. Thus, the organic EL element OLED continuously emits light with the brightness in accordance with the driving current Ioled.

Effective driving current Ieff in the case where the first driving mode and the second driving mode are alternately set will be described. A gate-to-source voltage applied to the gates of the transistors T1 and T2 is denoted by Vgs. When the transistors T1 and T2 operate in a saturation region, the data current Idata and the driving current Ioled in the first driving mode are represented by Equation 2. β denotes a gain coefficient and β=μA W/L, where μ, A, W, L, and Vth denote the carrier mobility, gate capacitance, channel width, channel length, and threshold voltage, respectively. The manufacturing parameters are inherent characteristics of the transistors and vary from transistor to transistor even when the transistors are designed to be the same type. The subscript "1" attached to the reference numerals indicates that the reference numerals are related to the transistor T1 and the subscript "2" attached to the reference numerals indicates that the reference numerals are related to the transistor T2.

$$Idata=1/2\beta1(Vgs-Vth1)^2$$

$$Ioled=1/2\beta2(Vgs-vth2)^2 \qquad \text{Equation 2}$$

Here, since the data current Idata is proportional to the driving current Ioled, when the proportional constant is K, the relationship represented by Equation 3 is established between the data current Idata and the driving current Ioled.

$$Ioled=K\cdot Idata=(1+\alpha)\cdot Idata \qquad \text{Equation 3}$$

The data current Idata and the driving current Ioled in setting the second driving mode can be represented by Equation 4.

$$Idata=1/2\beta2(Vgs-Vth2)^2$$

$$Ioled=1/2\beta1(Vgs-vth1)^2 \qquad \text{Equation 4}$$

Since the data current Idata is proportional to the driving current Ioled and the proportional constant is 1/K, the relationship represented by Equation 5 is established between the data current Idata and the driving current Ioled.

$$Ioled=1/K\cdot Idata=1/(1+\alpha)\cdot Idata=(1-\alpha)\cdot Idata \qquad \text{Equation 5}$$

When the first driving mode and the second driving mode are alternately set, I in the above-described equation 1 is replaced by Idata to make the effective driving current Ieff, as illustrated in Equation 1. Thus, current error with respect to the organic EL element OLED is significantly reduced.

As described above, according to the present exemplary embodiment, the pair of transistors T1 and T2 that constitute the current mirror alternately function as the programming element and the driving element. Thus, even if the inherent characteristics of the respective driving elements included in the display unit 1 are not uniform, it is possible to significantly reduce the errors of the effective driving current Ieff. As a result, the deterioration of the display property caused by current error can be effectively reduced or prevented.

Second Exemplary Embodiment

According to the present exemplary embodiment, a voltage programming method, specifically, a method of supplying data to the data lines X based on current, is disclosed. In the case of the voltage programming method, the above-described variable current source 4*a* is not necessary and the data-line driving circuit 4 outputs a data voltage Vdata in accordance with grayscale data that defines the display grayscale of the pixels 2 to the data lines X.

Figure 7:
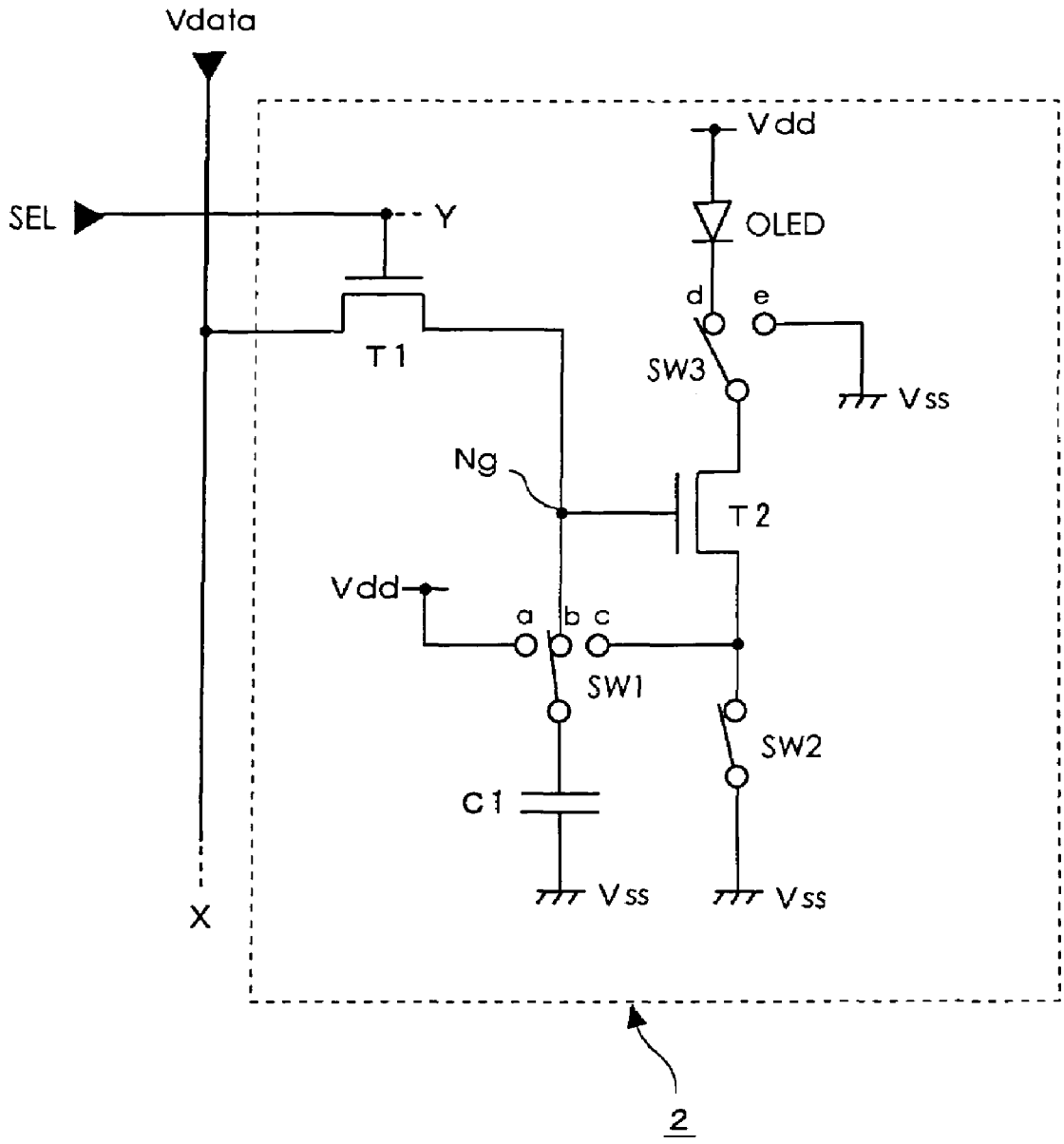
FIG. 7 is a pixel circuit schematic according to a second embodiment.

FIG. 7 is a pixel circuit schematic of a voltage programming method according to the present exemplary embodiment. Each pixel 2 includes the organic EL element OLED, the transistors T1 and T2, the capacitor C1, and three switching elements SW1 to SW3. The transistor T2 functions as both the programming element and the driving element.

The gate of the transistor T1 is connected to the scanning line Y to which the scanning signal SEL is supplied and the one terminal of the transistor T1 is connected to the data line X to which the data voltage Vdata is supplied. The other terminal of the transistor T1 is connected to the node Ng. The node Ng is connected to the gate of the transistor T2 and to a selection terminal "b" of the first switching element SW1 having three selection terminals "a" to "c". A source voltage Vdd is supplied to the selection terminal of the switching element SW1. The selection terminal "c" is commonly connected to one terminal of the transistor T2 and to one terminal of the second switching element SW2. One electrode of the capacitor C1 is connected to the fixed terminal of the first switching element SW1. A reference voltage Vss is supplied to the other electrode of the capacitor C1 and to the other terminal of the second switching element SW2. The other terminal of the transistor T2 is connected to the fixed terminal of the third switching element SW3 having two selection terminals "d" and "e". The selection terminal "d" of the switching element SW3 is connected to the cathode of the organic EL element OLED, to whose anode the source voltage Vdd is supplied. The reference voltage Vss is supplied to the selection terminal "e". The electric connection of the three switching elements SW1 to SW3 is controlled by a control signal output by the control circuit 5 (not shown).

Like in the first exemplary embodiment, the driving modes of the pixel circuit illustrated in FIG. 7 are composed of the first driving mode and the second driving mode and the driving modes are alternately set in a predetermined period (for example, every 1F). A series of processes in 1F are performed in the order of an initializing process, a data writing process, and a driving process.

Figure 8A:
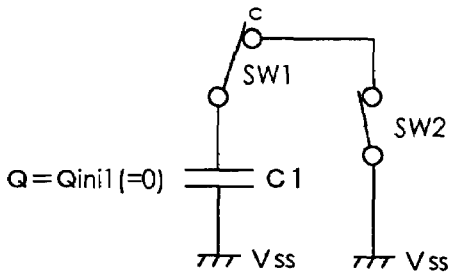
FIGS. 8A-8C are schematics illustrating operations in the first driving mode.
Figure 8B:
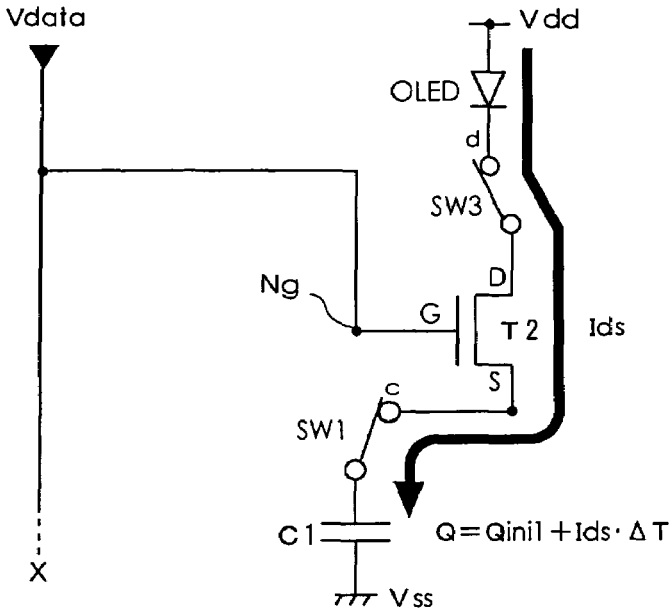
Figure 8C:
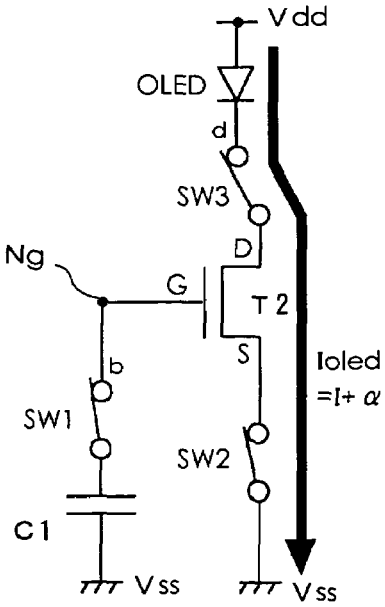

The processes in the first driving mode will be described with reference to FIGS. 8A-8C. When the first driving mode is set, the third switching element SW3 electrically connects the fixed terminal to the selection terminal "d". Thus, the cathode of the organic EL element OLED is electrically connected to the other terminal of the transistor T2. First, in the initializing process, in a state where the transistor T1 is switched off (the scanning signal SEL is at the L level), the first switching terminal SW1 electrically connects the fixed terminal to the selection terminal "c" and, at the same time, the second switching element SW2 is switched on. Thus, as illustrated in FIG. 8A, the charge accumulated in the capacitor C1 are discharged to the reference voltage Vss through the two switching elements SW1 and SW2. As a result, the charge Q is initially set as Qini1(=0).

In the subsequent data writing process, the scanning signal SEL is raised to the H level and the transistor t1 is switched on. Thus, the node Ng is electrically connected to the data lines X and the data voltage Vdata of the data lines X is supplied to the node Ng. The setting state of the first switching element SW1 is the same as that in the initializing process. However, the second switching element SW2 that was switched on is switched off. Thus, on the same path as illustrated in FIG. 8B, channel current Ids in accordance with the data voltage Vdata supplied to the gate Ng of the transistor T2 flows through the channel of the transistor T2. As a result, the capacitor C1 initially set at Qini1 is charged, and data is written in the capacitor C1 initially set as Qini1. The data (the charge Q) written in the capacitor C1 is arbitrarily set in accordance with the multiplication of the channel current Ids by the data writing time ΔT (uniform value) ($Q=Qini+Ids\cdot\Delta t$).

In the driving process, the scanning signal SEL is lowered to the L level again, the transistor T1 is switched off, and the node Ng is electrically separated from the data lines X. In this state, the first switching element SW1 electrically connects the fixed terminal to the selection terminal "b" and, at the same time, the second switching element SW2 is switched on again. Thus, on the same path as illustrated in FIG. 8C, the driving current Ioled flows through the organic EL element OLED. The driving current Ioled corresponds to the channel current of the transistor T2 and the current level of the driving current Ioled is controlled by the gate voltage Vg dependent on the data ($Qini+Ids\cdot\Delta T$) stored in the capacitor C1. The organic EL element OLED is set to have the brightness in accordance with the driving current Ioled.

Figure 9A:
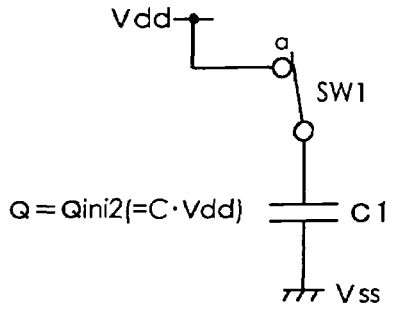
FIGS. 9A-9C are schematics illustrating operations in the second driving mode.
Figure 9B:
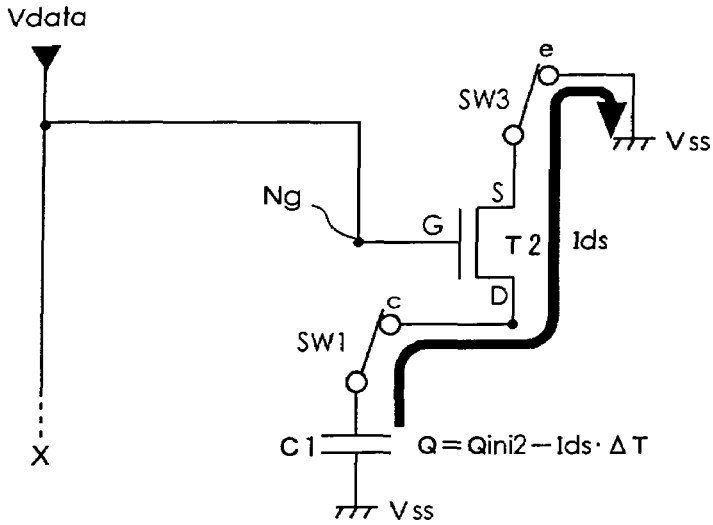
Figure 9C:
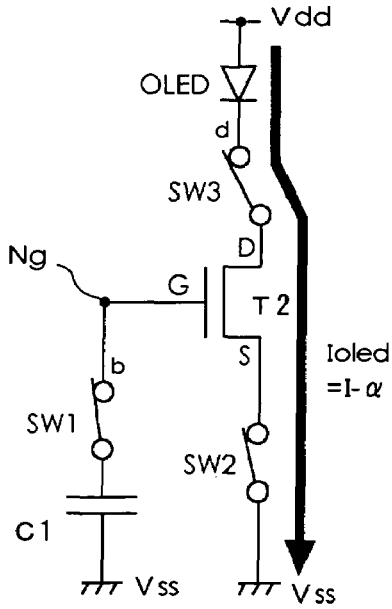

Next, the processes in the second driving mode will be described with reference to FIGS. 9A-9C. First, in the initializing process, in a state where the transistor T1 is switched off (the scanning signal SEL is at the L level), the first switching element SW1 electrically connects the fixed terminal to the selection terminal "a". Thus, as illustrated in FIG. 9A, the capacitor C1 is charged by the source voltage Vdd. As a result, the charge Q of the capacitor C1 is initially set as Qini2 ($=C\cdot Vdd$) (C is the capacitance of the capacitor C1).

In the subsequent data writing process, the scanning signal SEL is raised to the H level and the transistor T1 is switched on. Thus, the node Ng is electrically connected to the data lines X and the data voltage Vdata of the data lines X is supplied to the node Ng. In a state where the second switching element SW2 is switched off, the first switching element SW1 electrically connects the fixed terminal to the selection terminal "c". Thus, one electrode of the capacitor C1 is electrically connected to one terminal of the transistor T2. Since the third switching element SW3 electrically connects the fixed terminal to the selection terminal "e", the reference voltage Vss is supplied to the other terminal of the transistor T2. Thus, on the same path as illustrated in FIG. 9B, current in accordance with the data voltage Vdata supplied to the gate Ng of the transistor T2 flows through the channel of the transistor T2. Here, since the source and the drain of the transistor T2 are reversed in the setting of the first driving mode, the direction of the channel current Ids is reversed. As a result, charge is discharged from the capacitor C1 initially set as Qini2 and data is written in the capacitor C1 initially set as Qini2. The data (the charge Q) written in the capacitor C1 is set as $Qini2-Ids\cdot\Delta T$.

In the driving process, the scanning signal SEL is lowered to the L level again, the transistor T1 is switched off, and the node Ng is electrically separated from the data lines X. In this state, the first switching element SW1 electrically connects the fixed terminal to the selection terminal "b" and, at the same time, the second switching element SW2 is switched on again. Thus, on the same path as illustrated in FIG. 9C, the driving current Ioled flows through the organic EL element OLED. The driving current Ioled corresponds to the channel current of the transistor T2, and the current level of the driving current Ioled is controlled by the gate voltage Vg dependent on the data (Qini2−Ids·ΔT) stored in the capacitor C1. The organic EL element OLED is set to have the brightness in accordance with the driving current Ioled.

The effective driving current Ieff when the first driving mode and the second driving mode are alternately set will be examined. First, the case in which the actual driving ability of the transistor T2 is greater than the driving ability of a designed transistor due to the non-uniformity in the inherent characteristics of the driving elements DR will be considered. In this case, when the first driving mode is set, charge having a larger value than a desired value is charged in the capacitor C1 such that the level of the gate voltage Vg becomes higher than the original level. As a result, the driving current I+α obtained by adding the error α to the desired current I flows through the organic EL element OLED. When the second driving mode is set, charge having a larger value than a desired value is discharged from the capacitor C1 such that the level of the gate voltage Vg becomes lower than the original level. As a result, the driving current I−α obtained by subtracting the error α from the desired current I flows through the organic EL element OLED. When the driving modes are alternately set, the errors +α and −α having opposite polarities are offset such that the effective driving current Ieff is as represented in Equation 1. Thus, when the real driving ability of the transistor T2 is smaller than the driving ability of a designed transistor, the polarities of the error α in the first driving mode and in the second driving mode are reversed due to shortage of the charge charged in and discharged from the capacitor C1. Thus, in this case, the errors +α and −α having opposite polarities are offset and the effective driving current Ieff is as represented in Equation 1. As a result, the current error with respect to the organic EL element OLED is significantly reduced.

As described above, in the present exemplary embodiment, like in the first exemplary embodiment, even if the inherent characteristics of the driving elements are not uniform, it is possible to significantly reduce the error of the effective driving current Ieff. Thus, it is possible to effectively reduce or prevent display quality from deteriorating due to the current error.

According to the above-described exemplary embodiments, the period of switching between the first driving mode and the second driving mode is dependent on the use. For example, in the case of a display device, a period of no more than 1/30 second is preferable, and a period between 1/60 second and 1/120 second is more preferable. Thus, it is possible to effectively reduce or prevent the generation of flicker caused by changes in light-emitting brightness in both driving modes.

According to the above-described exemplary embodiments, the switching of the driving modes can be performed in units of pixels and can be performed in units of pixel rows corresponding to the direction in which the scanning lines Y extend in units of pixel column units corresponding to the direction in which the data lines X extend or in units of predetermined pixel blocks. These methods are effective when difference in brightness exists between when the first driving mode is set and when the second driving mode is set.

In combination with the methods according to the above-described exemplary embodiments, the method disclosed in the gazette of Japanese Unexamined Patent Application Publication No. 10-197896 or the method disclosed in the gazette of Japanese Unexamined Patent Application Publication No. 2003-66903 may be used. Accordingly, it is possible to further enhance display quality.

The above-described exemplary embodiments are applied to a display device. However, they may be applied to an electro-optical device, such as an optical head of a printer. Further, the electro-optical element is not limited to the organic EL element OLED but can be widely applied to an electro-optical device (such as an inorganic LED display device and a field-emission display device) whose brightness is set in accordance with driving current, or an electro-optical device (such as an electro-chromic display device and an electrophoresis display device) which represents transmittance and reflectance in accordance with driving current.

Furthermore, the electro-optical device according to the above-described exemplary embodiments can be mounted in various electronic apparatus including a television, a projector, a mobile telephone, a mobile terminal, a mobile computer, a personal computer, and a digital still camera. When the above-described electro-optical device is mounted in the electronic apparatus, it is possible to further enhance the quality of the electronic apparatus and to make the electronic apparatuses more attractive in the market.

What is claimed is:

1. A method of driving a pixel circuit having a driving element, a capacitor, and an electro-optical element, comprising:

first setting a brightness of the electro-optical element by generating a first driving current by the driving element in accordance with data stored in the capacitor, and by supplying the first driving current to the electro-optical element when a first driving mode is set;

second setting the brightness of the electro-optical element by generating a second driving current by the driving element in accordance with data stored in the capacitor, and by supplying the second driving current to the electro-optical element, when a second driving mode, having a different connection state from the first driving mode, is set, an error polarity of the second driving current being opposite to an error polarity of the first driving current; and third alternately switching between the first driving mode and the second driving mode in a predetermined period.

2. The method of driving a pixel circuit according to claim 1, further comprising:

when the first driving mode is set, writing data in the capacitor in accordance with data current supplied from outside of the pixel circuit by using a first transistor that constitutes a current mirror included in the pixel circuit; and generating the first driving current in accordance with data stored in the capacitor by using a second transistor that constitutes the current mirror as the driving element, and when the second driving mode is set, writing data in the capacitor in accordance with the data current by using the second transistor; and generating the second driving current in the capacitor in accordance with data stored by using the first transistor as the driving element.

3. The method of driving a pixel circuit according to claim 1, further comprising:

when the first driving mode is set, writing data in the capacitor by charging the capacitor by using a first current flowing through the channel of the driving element, when a data voltage supplied from outside is applied to a gate of the driving element, and when the second driving mode is set, writing data in the capacitor by discharging charge accumulated in the capacitor by using a second current flowing through the channel of the driving element in a reverse direction to the direction of the first current, when the data voltage is applied to the gate of the driving element.

4. The method of driving a pixel circuit according to claim 3, further comprising:

when the first driving mode is set, setting the capacitor in an initial state by discharging charge accumulated in the capacitor by applying a first voltage to one electrode of the capacitor prior to the step of writing data in the capacitor, and when the second mode is set, setting the capacitor in an initial state by charging the capacitor by applying a second voltage higher than the first voltage to one electrode of the capacitor prior to the step of writing data in the capacitor.

5. The method of driving a pixel circuit according to claim 1, switching between the first driving mode and the second driving mode being performed in units of pixels, in units of pixel rows, in units of pixel columns, or in units of pixel blocks.

6. The method of driving a pixel circuit according to claim 1, the predetermined period being no more than 1/30 second.

7. A pixel circuit, comprising:

a capacitor to store data;

a driving element to generate a driving current in accordance with data stored in the capacitor and having a gate thereof connected to the capacitor;

an electro-optical element, whose brightness is set in accordance with the driving current supplied from the driving element; and a connector to set a connection state of the pixel circuit such that the driving element generates a first driving current in accordance with data stored in the capacitor when a first driving mode is set, and to set the connection state of the pixel circuit such that the driving element generates a second driving current, whose error polarity is opposite to an error polarity of the first driving current, in accordance with data stored in the capacitor when a second driving mode, which is alternately switched to the first driving mode in a predetermined period, is set.

8. A pixel circuit, comprising:

a capacitor to store data;

first and second transistors constituting a current mirror and having gates connected to a node to which one electrode of the capacitor is connected; and an electro-optical element, whose brightness is set by a driving current flowing therethrough, when a first driving mode is set, the first transistor functioning as a programming element to write data in the capacitor in accordance with data current supplied from the outside of the pixel circuit, and the second transistor functioning as a driving element to generate the driving current in accordance with data stored in the capacitor, and when a second driving mode, which is alternately switched to the first driving mode in a predetermined period, is set, the second transistor functioning as the programming element and the first transistor functioning as the driving element.

9. A pixel circuit, comprising:

a capacitor to store data;

first and second transistors constituting a current mirror and having gates connected to a node to which one electrode of the capacitor is connected; and an electro-optical element, whose brightness is set by a driving current flowing therethrough, when a first driving mode is set, the first transistor functioning as a programming element to write data in the capacitor in accordance with data current supplied from the outside of the pixel circuit, and the second transistor functioning as a driving element to generate the driving current in accordance with data stored in the capacitor, and when a second driving mode, which is alternately switched to the first driving mode in a predetermined period, is set, the second transistor functioning as the programming element and the first transistor functioning as the driving element;

a third transistor, one terminal of which is connected to the node while another terminal thereof is connected to one terminal of the first transistor, the third transistor being switched on when the first driving mode is set and being switched off when the second driving mode is set;

a fourth transistor, one terminal of which is connected to the node while another terminal thereof is connected to the one terminal of the second transistor, the fourth transistor being switched on when the second driving mode is set and being switched off when the first driving mode is set;

a fifth transistor, one terminal of which is connected to one terminal of the first transistor while another terminal thereof is connected to the electro-optical element, the fifth transistor being switched on when the second driving mode is set and being switched off when the first driving mode is set; and a sixth transistor, one terminal of which is connected to one terminal of the second transistor while another terminal thereof is connected to the electro-optical element, the sixth transistor being switched on when the first driving mode is set and being switched off when the second driving mode is set.

10. The pixel circuit according to claim 7, switching between the first driving mode and the second driving mode being performed in units of pixels, in units of pixel rows, in units of pixel columns, or in units of pixel blocks.

11. The pixel circuit according to claim 7, the predetermined period being no more than 1/30 second.

12. An electro-optical device, comprising:

a plurality of scanning lines;

a plurality of data lines;

a plurality of pixel circuits provided corresponding to intersections of the scanning lines and the data lines;

a scanning-line driving circuit to select the scanning lines corresponding to the pixel circuits in which data is to be written by outputting a scanning signal to the scanning lines; and a data-line driving circuit to output data to the data lines corresponding to the pixel circuits in which data is to be written in cooperation with the scanning-line driving circuit, the pixel circuit being the pixel circuit according to claim 7.

13. An electronic apparatus, comprising:

the electro-optical device according to claim 12.

* * * * *